United States Patent [19]

Leopoldi et al.

[11] 4,378,885

[45] Apr. 5, 1983

[54] PILL BOX

[75] Inventors: Norbert Leopoldi, Chicago; William P. Heinrich, McHenry, both of Ill.

[73] Assignee: Cloverline, Inc., Chicago, Ill.

[21] Appl. No.: 254,921

[22] Filed: Apr. 16, 1981

[51] Int. Cl.[3] ..... B65D 83/04; B65D 85/56; B65D 43/14

[52] U.S. Cl. ..... 206/540; 220/4 B

[58] Field of Search ..... 206/533, 539, 540, 528; 220/350, 20, 4 B, 4 E

[56] References Cited

U.S. PATENT DOCUMENTS

| | | | |
|---|---|---|---|
| 153,308 | 7/1874 | Blood | 206/536 |
| 662,353 | 11/1900 | Clement | 206/540 |
| 1,214,158 | 1/1917 | Hansen | 220/350 |
| 2,412,332 | 12/1946 | Hansen | 220/20 |
| 2,638,240 | 5/1953 | Lundstrom | 206/538 |

*Primary Examiner*—William T. Dixson, Jr.

*Attorney, Agent, or Firm*—McWilliams, Mann, Zummer & Sweeney

[57] ABSTRACT

This invention relates to a pill box comprised of three parts including a shell bottom, a shell top and a slip ring so interrelated that the slip ring holds the top and bottom parts assembled with the slip ring rotatable relative to the assembled parts. The top and bottom parts are nonrotative relative to each other and are formed to cooperate to form a pill discharge opening normally closed by the slip ring with the ring formed with an opening adapted to be aligned with the discharge opening for discharge of a pill from the assembled box.

3 Claims, 5 Drawing Figures

PILL BOX

BACKGROUND OF THE INVENTION

1. Field of the Invention

The invention relates to pill boxes of the type for personal use and normally carried on a daily basis in ones pocket, or in a purse.

2. Description of the Prior Art

Heretofore, containers have been provided for pills which were designed as pocket containers adapted to be carried on the person, or in a purse and were adapted to dispense one or more pills at a time for use of the person carrying the container.

Some such containers were quite elaborate, being ornamental and some including a timing mechanism to remind the uses when a pill might be due to be taken.

Other devices were somewhat more simple and comprised nothing more than a screw top container, or provided with a hinged cover adapted to be snapped shut. Some devices included covers that were removable and adapted to be secured in place by a snap fit.

Pill boxes have also been designed for carrying on a chain around the neck and others have been adapted for carrying on a key chain, or the like. In practically all such prior devices it was necessary to open the container by removing a top, or cover, to gain access to the pills in the interior of the container and some were made with difficult to open closures intended to be child proof.

SUMMARY OF THE INVENTION

This invention provides a personal pill box of simplified design and operation adapted to provide a supply of pills for use during the day when a person is away from a normal quantity of pills, such as the total amount prescribed by a physician to cover a certain period of time while the pill box merely provides a single day's supply.

The pill box is of circular form and consists of a top, a bottom and an enclosing ring. The top and bottom shells are of similar design and each comprise a hollow cup shaped shell adapted to be disposed in opposed relation to form a hollow container.

The bottom shell is formed with an internal annular bearing race adjacent to the top edge of the shell and the top shell is formed with an annular depending flange at the bottom edge of the shell and this depending flange fits into the bearing race of the bottom shell to form a fully enclosed container of round form having generally flat top and bottom surfaces.

Both the top shell and the bottom shell are formed also with an outstanding peripheral flange, or rim, which are disposed in abutting relation to fix the degree of entry of the annular depending flange on the top shell into the bearing race of the bottom shell. The outstanding abutting flanges around the periphery of the pill box form a track and guide for mounting the enclosing ring member on the assembled top and bottom shells.

The ring member is circular and fits about the periphery of the two shells and is provided with a continuous internal raceway into which the outstanding peripheral flanges on the two shells engage and are thereby maintained in their assembled relationship abutting each other.

The ring member is rotatable on the assembled hollow shells and the interengaging relationship of the outstanding flanges on the two shells with the circular internal guideway on the ring member serves not only to maintain the top and bottom shells assembled but also acts as a guideway for the relative rotative sliding relationship of the parts when the rim member is rotated relative to the assembled pill box parts.

The top and bottom shells are interlocked against relative rotating movements so that only the ring member rotates relative to the two shells and relative rotation of the ring on the shells is limited by internal stops which engage a fixed abutment on the shells.

The two shells are each formed with one half of a pill discharge opening and these half openings cooperate in the assembled position of the shells to form the discharge opening, which is disposed toward what is identified as the front of the pill box.

The encircling rim member is provided with an opening conforming in size and shape with the opening formed by the two halves in the top and bottom shells. When the ring, or rim member, is disposed in position to dispose the opening therein in alignment with the opening in the pill box shells a pill may be discharged, or removed, through the aligned openings but when the ring is rotated into another position against the internal stops the discharge opening will be closed to prevent removal of a pill while the parts are disposed in this relationship.

DESCRIPTION OF THE DRAWINGS

The pill box of this invention having the features described is illustrated in the accompanying drawings, wherein.

DESCRIPTION OF PREFERRED EMBODIMENT

Figure 1:
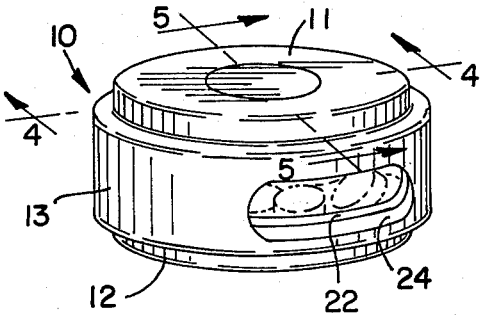
FIG. 1 is a general perspective view of this pill box drawn to enlarged scale to reveal the several features of the invention.
Figure 2:
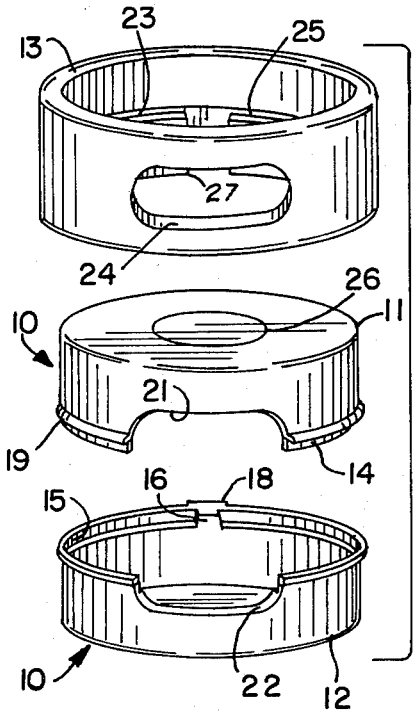
FIG. 2 is an exploded perspective view of the pill box showing the three parts in their relative positions for assembly.
Figure 3:
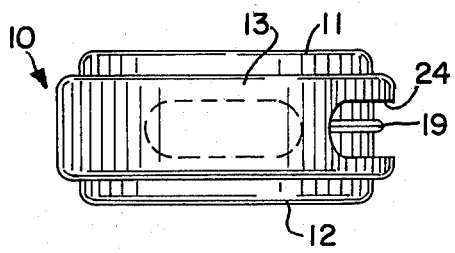
FIG. 3 is a front elevational view of the pill box with the pill discharge opening closed by the overlying ring member.
Figure 4:
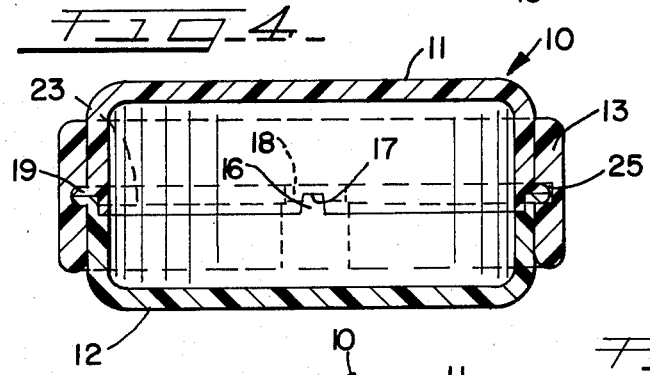
FIGS. 4 and 5 are detail cross sectional views through the pill box taken respectively on the lines 4—4 and 5—5 indicated in FIG. 1.
Figure 5:
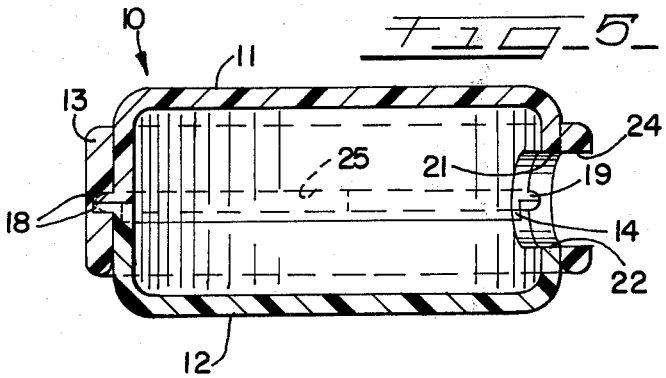

In the drawings the reference 10, as indicated in FIG. 1, represents a pill box of round form and which consists of a top shell 11 and a bottom shell 12 enclosed by an encircling ring member 13. The top and bottom shells are of substantially similar form comprising circular cup-shaped members adapted to be assembled edge-to-edge to form a hollow container. The top shell 11 is formed with an annular depending flange 14 that fits into an annular internal seat, or bearing race 15 extending around the periphery of the bottom shell 12, when the two shells are assembled in box forming relation. The raceway 15 is made with a key 16 of the same height, or depth, as the bearing seat 15 and projecting inwardly of the shell member 12 to the same dimension as to be flush with the internal diameter of the bottom shell cup-shaped body. The key 16 fits into a keyway 17 in the depending flange portion 14 of the top shell member 11 so that the top and bottom shells 11 and 12 are interlocked against relative rotation when assembled in the box-like form.

The key 16 and keyway 17 are located at the rear of the pill box as is a rearwardly projecting abutment 18 formed on both the top and bottom shells and which are in vertical alignment when the shells are assembled with the key 16 and keyway 17 engaged in interlocking relationship. The top shell 11 is made with an outstanding peripheral flange 19 and the bottom shell 12 is made with an outstanding corresponding flange 20 so that when the two shells are disposed in box forming relation with the depending flange 14 entered into the seat 15 the flanges 19 and 20 act to define the degree of entry of the depending flange 14 into the seat 15 and the abutting flanges 19 and 20 form an outstanding rim extending around the pill box shells 11 and 12.

The top shell is made with an elongated opening 21 disposed at the front of the shell and the bottom shell is made with a similar elongated opening 22 and which, when the two shells are brought together with such openings in opposite relation, form a discharge opening for removing pills, one at a time, from the box interior. The elongaged openings 19 and 20 thus each form one half of the pill discharge opening. The top and bottom shells 11 and 12 are retained in assembled face-to-face box forming relationship by the ring member 13 which is made with an internal raceway 23 extending around the inside of the ring and into which the rim formed by the outstanding flanges 19 and 20 on the top and bottom shells, is received so that the rim functions as a track and the raceway 23 acts as a guideway during rotation of the ring 13 relative to the assembled shells 11 and 12.

The ring 13 completely encircles and encloses the shells 11 and 12 and substantially overlies the outer face of the assembled shells. In practice the pill box has been made with a diameter of approximately one and one/-half inches ($1\frac{1}{2}''$) and of a depth of about three quarters of an inch ($\frac{3}{4}''$) with the enclosing ring having a height of about a half an inch ($\frac{1}{2}''$) so that the ring embraces the rim on the pill box shells formed by the flanges 19 and 20 extends above and below the rim to overlie each of the shells on their outer peripheries and therby afford sufficient contact to maintain a stable condition of the assembly and provide for a smooth operating relationship.

The ring is provided with a front opening 24 corresponding in size to the discharge opening formed in the pill box shells 11 and 12 by the respective half openings 21 and 22 in the top and bottom shells. When the ring 13 is turned to align the opening 24 with the discharge opening in the assembled pill box a pill may be removed through the aligned openings but when the ring is turned to dispose the opening 24 to one side of the discharge opening the latter is closed and pills in the interior of the pill box are positively prevented from escaping from the pill box. Thus, the enclosing ring 13 becomes a slip ring capable of being rotated, or turned around the pill box shells to control the removal of one or more pills from the container, or for loading pills into the container.

Both the shells 11 and 12 and the slip ring 13 are made from a suitable plastic material such as polypropylene and the three parts are assembled by inserting the assembled top and bottom shells into the ring by a snap fit. The ring 13 encloses the entire periphery of the top and bottom shells, including the projecting abutments 18 at the rear of the shells. An opening 27 in the inner bottom area of the ring 13 below the raceway 23 permits assembly of the ring over the abutment 18. The ring is designed to open or close the pill discharge opening by a one quarter turn and for this purpose the ring includes an internal channel 25 which overlies the abutment 18 and is recessed into the inner surface of the ring for something slightly more than the one quarter turning movements required, whereby to provide about 90° of rotation for the ring relative to the shells. When the ring is turned on the shells 11 and 12 in a clockwise direction the opening 24 is brought into full registry with the discharge opening 21/22 at about the time that the limit of movement afforded by the channel 25 comes into contact with the abutment 18 and when the ring is rotated counterclockwise the discharge opening is fully closed when the opposite limit of movement provided by the channel 25 contacts the abutment 18.

If desired the top shell 11 may have a central area 26 smoothly finished and of round formed affording a location for a logo or the like if an advertiser should wish to include an advertising message or an identity label.

Thus, it will be seen that a pill box has been provided of very simple form, easily produced and inexpensive enough to be distributed gratis as an advertising promotion. The pill box parts are made from a plastic such as polypropylene, both for ease of operation and economy of manufacture, which is enhanced by assembling the pill box from but three parts comprised of an upper box part, a lower box part and an enclosing member which maintains the assembly and provides a means of covering and uncovering a discharge opening for pills to be removed, or loaded.

What is claimed is:

1. A pill box of circular form comprised of a top box member, a bottom box member, and an enclosure surrounding the top and bottom box members and having relative sliding movement around the box parts to control the loading and discharge of pills from the pill box, said box members each have an outstanding rim forming a track upon which the enclosure is mounted, a guideway in the enclosure embracing both said outstanding rims, said guideway overlapping said rims to maintain said top and bottom box members in assembled relation, said bottom box member having an annular bearing seat around the inner periphery thereof, said top box member formed with an annular depending flange fitting into said bearing seat, said outstanding rim members on the top and bottom box members limiting entry of said depending annular flange into said bearing seat, said top and bottom box members each having an opening disposed in opposite relation which when aligned form a pill discharge opening in the assembled pill box members, said enclosure being formed with an opening adapted to register with said opposed openings in the top and bottom boxes when the enclosure is rotated to align the opening therein with the opposed openings in the box members, a keyway formed in a facing edge of one of said box members, and a key formed in an opposing edge of the other box member, said key and keyway being engaged to interlock the box members against relative rotation.

2. A pill box as set forth in claim 1 wherein said box members are formed with vertically aligned outwardly projecting abutment members, and said enclosure is formed with an internal channel recessed into the inner surface of the enclosure and overlying said abutment members.

3. A pill box as set forth in claim 2 wherein said internal channel limits rotation of the enclosure relative to said abutment to approximately one quarter turn.

* * * * *